US009644317B2

(12) United States Patent
McCanty

(10) Patent No.: US 9,644,317 B2
(45) Date of Patent: May 9, 2017

(54) CONTINUOUS DIGESTER AND FEEDING SYSTEM

(71) Applicant: INTERNATIONAL PAPER COMPANY, Memphis, TN (US)

(72) Inventor: Kevin M. McCanty, Cincinnati, OH (US)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 14/554,105

(22) Filed: Nov. 26, 2014

(65) Prior Publication Data

US 2016/0145797 A1 May 26, 2016

(51) Int. Cl.
*D21C 7/06* (2006.01)
*D21C 7/10* (2006.01)
(Continued)

(52) U.S. Cl.
CPC ..... *D21C 7/06* (2013.01); *D21C 3/00* (2013.01); *D21C 7/00* (2013.01); *D21C 7/10* (2013.01); *D21C 7/14* (2013.01); *D21C 11/0021* (2013.01)

(58) Field of Classification Search
CPC ... D21C 7/00; D21C 7/06; D21C 7/08; D21C 7/10; D21C 7/14
See application file for complete search history.

(56) References Cited

U.S. PATENT DOCUMENTS 2,803,540 A * 8/1957 Durant ..... D21C 7/08 162/236
2,809,111 A * 10/1957 Durant ..... D21C 7/00 162/239
(Continued)

FOREIGN PATENT DOCUMENTS

CA 2247949 9/1997
CA 2565358 10/2006
(Continued)

OTHER PUBLICATIONS

Peuhkuri, Stabilizing the continuous digester process, Oct. 2009—www.metso.com-Automation-pc-web_articles.nsf-WebWID-WTB-100209-22570-077FA—open document U6Q6x4WwWt8.
(Continued)

*Primary Examiner* — Anthony Calandra
(74) *Attorney, Agent, or Firm* — Thomas W. Barnes, III

(57) ABSTRACT

One embodiment provides an apparatus for cooking lignocellulosic material, comprising a pressurizable, inclined top separator including a sluicing liquor inlet for receiving a sluicing mixture comprising impregnated lignocellulosic material and sluicing liquor, a hot black liquor inlet, an excess liquor outlet, and an impregnated lignocellulosic material outlet; a continuous digester vessel including an impregnated lignocellulosic material inlet in communication with the impregnated lignocellulosic material outlet, and a warm black liquor outlet; and a black liquor circulation and heating loop including a warm black liquor inlet in communication with said warm black liquor outlet, a heater for heating warm black liquor to produce hot black liquor, and a hot black liquor outlet in communication with said hot black liquor inlet. Methods of making and using the apparatus are also provided.

47 Claims, 11 Drawing Sheets

(51) Int. Cl.

| | |
|---|---|
| ***D21C 7/14*** | (2006.01) |
| ***D21C 11/00*** | (2006.01) |
| ***D21C 3/00*** | (2006.01) |
| ***D21C 7/00*** | (2006.01) |

(56) References Cited

U.S. PATENT DOCUMENTS

| | | | | |
|---|---|---|---|---|
| 2,858,211 | A * | 10/1958 | Durant | D21C 7/00 162/19 |
| 3,429,773 | A * | 2/1969 | Richter | D21C 7/00 162/237 |
| 3,471,365 | A | 10/1969 | Asplund | |
| 3,532,594 | A | 10/1970 | Richter | |
| 3,585,104 | A | 6/1971 | Kleinert | |
| 3,700,548 | A * | 10/1972 | Rich | D21C 3/24 162/17 |
| 4,259,147 | A | 3/1981 | Gordy | |
| 4,491,504 | A * | 1/1985 | Engall | B01J 3/02 162/237 |
| 5,203,963 | A * | 4/1993 | Henricson | D21C 3/24 162/19 |
| 5,503,709 | A | 4/1996 | Burton | |
| 5,628,873 | A | 5/1997 | Johanson et al. | |
| 5,716,497 | A | 2/1998 | Richter et al. | |
| 5,779,856 | A | 7/1998 | Kettunen | |
| 5,885,414 | A | 3/1999 | Lindstrom et al. | |
| 6,103,058 | A | 8/2000 | Engstrom | |
| 6,123,807 | A | 9/2000 | Engstrom et al. | |
| 6,159,336 | A | 12/2000 | Engstrom et al. | |
| 6,171,494 | B1 | 1/2001 | Snekkenes et al. | |
| 6,203,662 | B1 | 3/2001 | Snekkenes et al. | |
| 6,368,453 | B1 | 4/2002 | Kettunen et al. | |
| 6,582,554 | B1 * | 6/2003 | Henricson | D21C 3/22 162/17 |
| 7,381,302 | B2 | 6/2008 | Snekkenes et al. | |
| 7,540,937 | B2 | 6/2009 | Snekkenes et al. | |
| 7,615,134 | B2 | 11/2009 | Snekkenes et al. | |
| 7,666,637 | B2 | 2/2010 | Nguyen | |
| 7,867,363 | B2 | 1/2011 | Turqueti | |
| 8,317,975 | B2 | 11/2012 | Amidon et al. | |
| 8,617,355 | B2 | 12/2013 | Romero et al. | |
| 8,641,865 | B2 | 2/2014 | Engstrom et al. | |
| 8,668,806 | B2 | 3/2014 | Amidon et al. | |
| 8,986,500 | B2 * | 3/2015 | Samuelsson | D21C 1/02 162/68 |
| 2001/0000588 | A1 | 5/2001 | Snekkenes | |
| 2002/0026991 | A1 * | 3/2002 | Stromberg | D21C 3/02 162/19 |
| 2004/0089431 | A1 | 5/2004 | Fant et al. | |
| 2004/0112554 | A1 * | 6/2004 | Snekkenes | D21C 7/14 162/19 |
| 2006/0169430 | A1 | 8/2006 | Tarasenko | |
| 2008/0029233 | A1 | 2/2008 | Wingerson et al. | |
| 2008/0210392 | A1 * | 9/2008 | Snekkenes | D21C 1/00 162/17 |
| 2008/0314534 | A1 | 12/2008 | Calandra | |
| 2013/0240167 | A1 * | 9/2013 | Trolin | D21C 1/06 162/17 |

FOREIGN PATENT DOCUMENTS

| | | |
|---|---|---|
| CA | 2645382 | 11/2008 |
| EP | 0662169 | 8/1992 |
| EP | 0748412 | 3/1995 |
| GB | 371001 | 4/1932 |

OTHER PUBLICATIONS

Greer, Pulp and Paper Magazine—www.risiinfo.com-magazines-September-2004-PP-Digester-Additives-Discloses improving digester with chemical additives.

Pelletier, Process control—Pulp and Paper Magazine—www.risiinfo.com-db_area-archive-p_p_mag-2000-005-feat3.htm.

Jansson, Model Based Control and Optimization of Continuous Digester—www.tappsa.co.za-archive3-Journal_papers-Continuous_digester-continuous_digester.html—2014.

* cited by examiner

CONTINUOUS DIGESTER AND FEEDING SYSTEM

FIELD OF THE INVENTION

The present invention relates to the papermaking industry and devices and methods used therein, and particularly those devices and methods for cooking pulp.

BACKGROUND

To meet increasing demands and decreasing margins for paper products, pulp producers look for ways to maximize pulp production. One result is that pulp digesters become overloaded, i.e., they are run to their production limits. At these limits, the digester typically cooks pulp at very high temperatures with low retention times. Introducing cool white liquor to the process reduces the cooking temperature and negatively impacts the production level.

For example, in single-vessel vapor phase digesters, and particularly those in production lines that lack internal liquor impregnation or otherwise are not fed with internally impregnated chips, the lack of impregnation leads to undesirably high reject levels, e.g., up to 10% by weight at 17 Kappa number. Even in lines having internal liquor impregnation, as noted above, the introduction of cool white liquor from the impregnation into the digester reduces the cooking temperature and negatively impacts the production level. Heating the impregnated chips beforehand exacts a high energy cost, however.

These and other problems are solved by embodiments of the present invention, one of which provides a system and method to deliver impregnated lignocellulosic material to the digester while maintaining the feed at an elevated temperature.

BRIEF DESCRIPTION OF THE SEVERAL EMBODIMENTS

Figure 1:
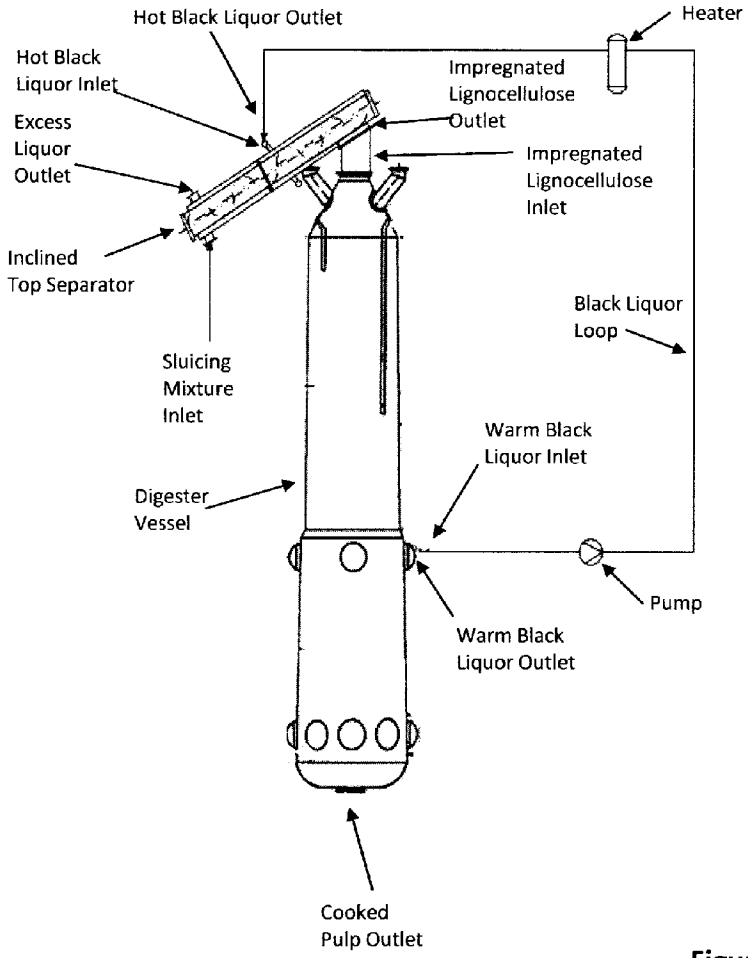
FIG. 1 shows a schematic representation of one embodiment.

One embodiment provides a system to deliver lignocellulosic material (e.g., chips) impregnated with cooking liquor into a digester while maintaining the feed at an elevated temperature. In one embodiment, the chips may be impregnated with cooking liquor at a low temperature and then fed into the digester at much higher temperature. One advantage is that digester production levels and pulp quality are maintained in an energy efficient manner and at a relatively low capital cost.

The inventors have found that conventional methods of feeding a digester at low temperatures can severely limit the digester production because of the heating and retention time limitations in the digester. If chip impregnation occurs at atmospheric conditions, the temperature of the cooking liquor in the impregnation system typically remains below 100° C. during this step. The inventors have found that it is difficult to keep the impregnation system cool while allowing the impregnated chip feed to the digester to remain at high temperature without the excessive use of cooling media and still maintain good energy efficiency. One embodiment overcomes these and other problems at least in part providing operators with the ability to operate the impregnation system at a low temperature while maintaining the ability to feed the chips to the digester at high temperature. By resort to one or more embodiments herein, a more uniformly cooked pulp with lower reject levels can be obtained, bleachability can be enhanced, consumption of bleaching chemicals may be lowered, and lower operating costs may be achieved.

One embodiment provides an apparatus for cooking lignocellulosic material, comprising:

a pressurizable, inclined top separator including a sluicing liquor inlet for receiving a sluicing mixture comprising impregnated lignocellulosic material and sluicing liquor, a hot black liquor inlet, an excess liquor outlet, and an impregnated lignocellulosic material outlet;

a continuous digester vessel including an impregnated lignocellulosic material inlet in communication with the impregnated lignocellulosic material outlet, and a warm black liquor outlet; and a black liquor circulation and heating loop including a warm black liquor inlet in communication with said warm black liquor outlet, a heater for heating warm black liquor to produce hot black liquor, and a hot black liquor outlet in communication with said hot black liquor inlet.

Another embodiment provides a process, comprising producing a cooked pulp using the apparatus.

Another embodiment provides a process for cooking pulp, comprising introducing, under pressure, a sluicing mixture comprising impregnated lignocellulosic material and sluicing liquor into a pressurized, inclined top separator;

heating and separating, under pressure, the impregnated lignocellulosic material in the inclined top separator from at least a portion of the sluicing liquor, to produce heated impregnated lignocellulosic material; and conveying, under pressure, the heated impregnated lignocellulosic material to a continuous, pressurized digester vessel, and cooking, to produce a cooked pulp;

wherein said pressures in the introducing, heating, separating, and conveying are sufficient to prevent said sluicing liquor from boiling.

Another embodiment provides a process for making a paper product, comprising producing cooked pulp according to the aforementioned process, and thereafter converting all or a portion of the cooked pulp into a paper product.

Another embodiment provides a process for making pulp, comprising producing cooked pulp according to the aforementioned process.

In another embodiment, a novel use of an external inclined top separator is provided.

One embodiment is shown schematically in FIG. 1. A continuous digester vessel is shown, having mounted on an upper end thereof a pressurizable, inclined top separator. The separator has a lower end including a sluicing liquor inlet for receiving a sluicing mixture. The sluicing mixture desirably includes impregnated lignocellulosic material and sluicing liquor. An excess liquor outlet is also disposed at the lower end of the separator, through which excess liquor can exit the separator. The separator includes a hot black liquor inlet through which hot black liquor can enter the separator. At the upper end of the separator, an impregnated lignocellulosic material outlet is disposed, through which impregnated lignocellulosic material may pass into the digester via a corresponding impregnated lignocellulosic material inlet at the upper end of the digester.

Figure 10:
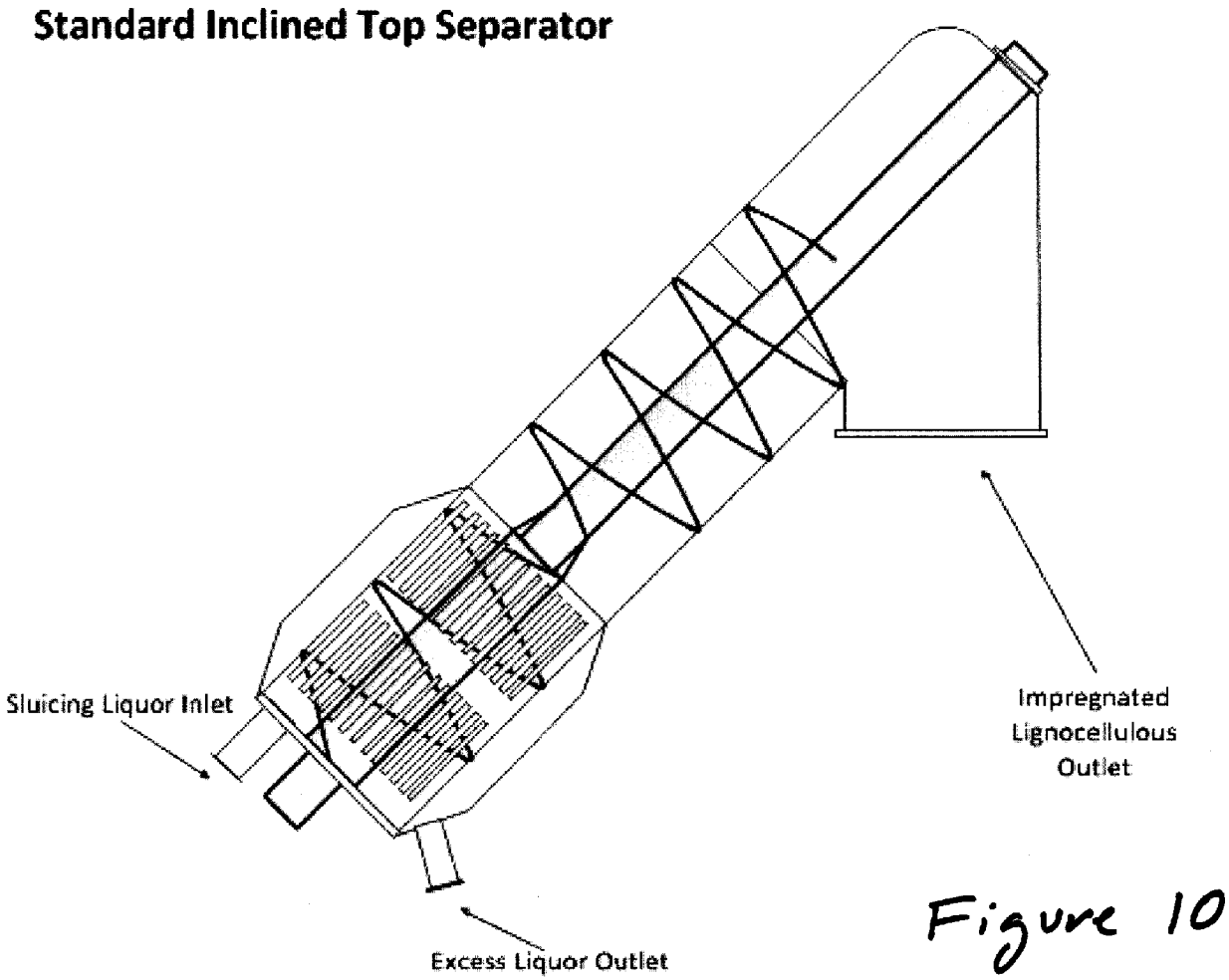
FIG. 10 shows a schematic representation of a standard inclined top separator.
Figure 11:
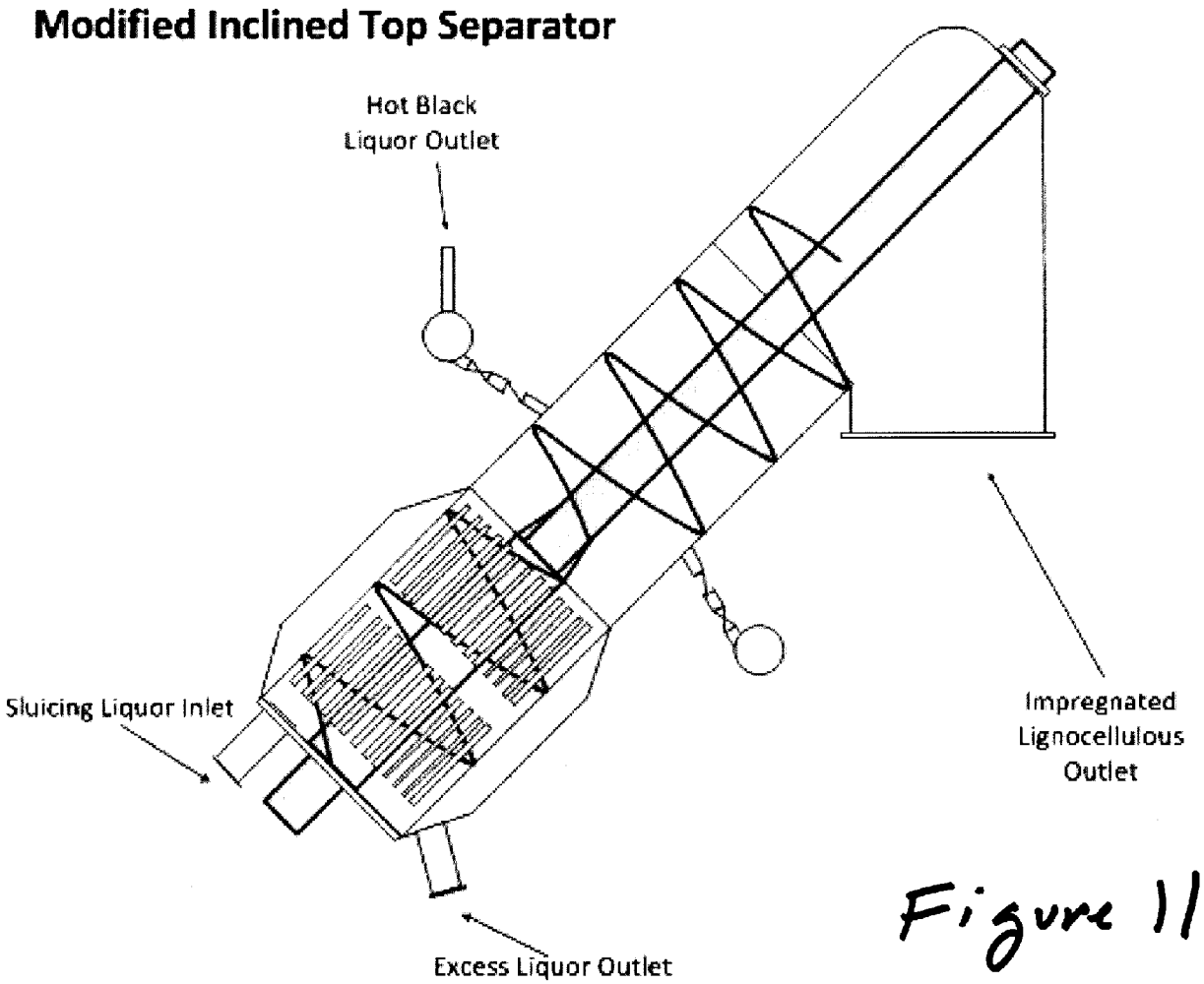
FIG. 11 shows a schematic representation of another embodiment.

The inclined top separator may include one or more of a screen or screw and is adapted to separate impregnated lignocellulosic material from at least a portion of sluicing liquor and convey the thus-separated impregnated lignocellulosic material to the impregnated lignocellulosic material outlet. Such separators are known, and are available, for example, from Valmet Curitiba, Brazil, Karlstad Sweden, or Andritz. FIG. 10 shows a standard inclined top separator. FIG. 11 shows a modified inclined top separator, which is modified to include the hot black liquor inlet through which hot black liquor can enter the separator from the hot black liquor outlet of the black liquor circulation and heating loop.

As shown in FIG. 1, the impregnated lignocellulosic material outlet of the separator is in communication with the impregnated lignocellulosic material inlet of the digester. The digester vessel includes a warm black liquor outlet disposed between the upper and lower ends thereof, through which warm black liquor can be withdrawn. The warm black liquor upon leaving the digester enters an upstream portion of a black liquor circulation and heating loop via a warm black liquor inlet in communication with the warm black liquor outlet of the digester. One or more optional pumps may be present in the black liquor circulation and heating loop for circulating the black liquor. The warm black liquor is heated by a heater, whereby hot black liquor is produced. One or more than one heater may be present in the black liquor heating and circulation loop. The heater may be a heat exchanger, wherein heat energy from steam or other heat source indirectly or directly heats the warm black liquor to produce hot black liquor. The heater and pump may be present in any order—upstream and/or downstream of one another—along the length of the black liquor heating and circulation loop.

The hot black liquor exits the downstream end of the circulation loop through a hot black liquor outlet and enters the separator via a corresponding hot black liquor inlet in the separator. The hot black liquor contacts the impregnated lignocellulosic material in the separator, whereby at least the impregnated lignocellulosic material is heated. In one embodiment, the inclined top separator is adapted to combine and heat the impregnated lignocellulosic material with the hot black liquor. In one embodiment, the separator and its contents experience or are subject to a heat gradient that increases from the lower end to the upper end, i.e., the upper end of the separator is hotter than the lower end.

The digester also includes a cooked pulp outlet at a lower end thereof, through which cooked pulp may be withdrawn. So long as the digester vessel is adapted to produce cooked pulp from impregnated lignocellulose material, it is not particularly limited. For example, the digester vessel is a vapor-phase digester, hydraulic digester, single-vessel digester, or two-vessel digester, batch digester, continuous digester, or combination thereof as appropriate. In one embodiment, the digester vessel is a continuous single-vessel, vapor-phase digester. Digesters are known in the art, and may be obtained, for example, from Valmet, Voith, Andritz, and other manufacturers.

Figure 2:
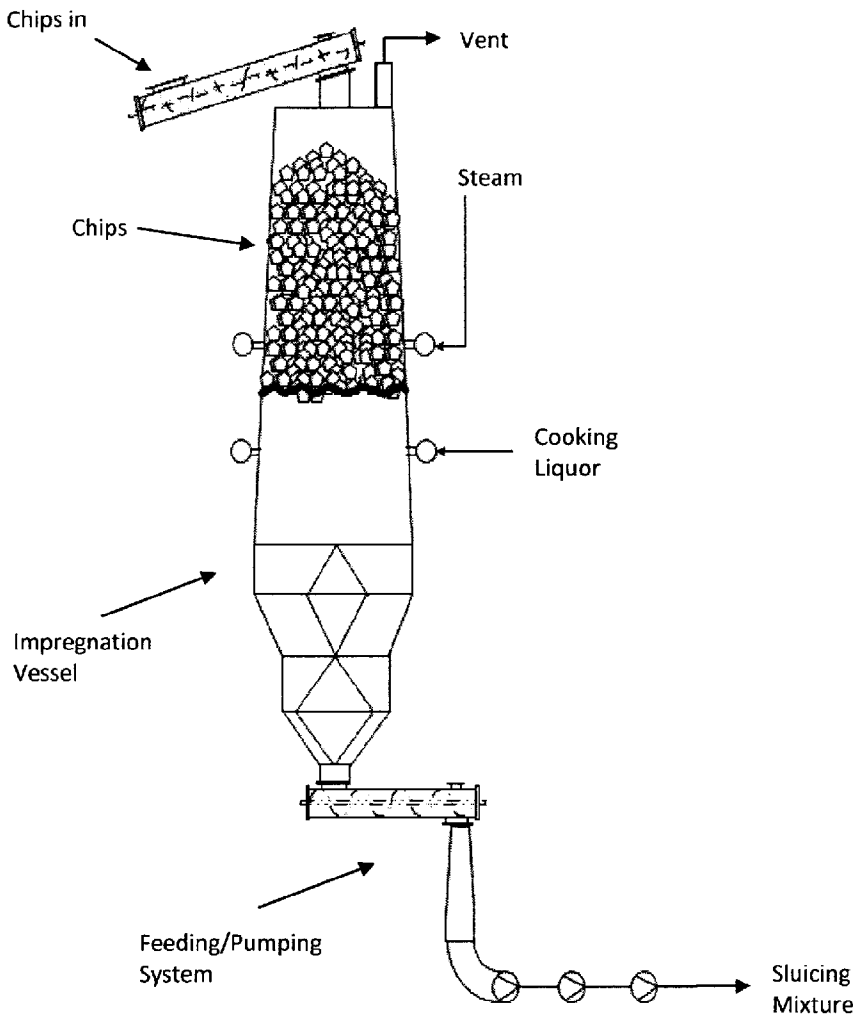
FIG. 2 shows a schematic representation of another embodiment.

FIG. 2 shows a schematic drawing of another embodiment. An ambient pressure impregnation vessel is shown, which is adapted to produce impregnated lignocellulose material. Uncooked chips enter the impregnation vessel at an upper end thereof. A vent is shown, which enables the impregnation vessel to run at ambient pressure. As used herein, ambient pressure is that typically experienced at sea level, or about 1 bar. Inside the impregnation vessel, chips are first exposed to steam, which enters through an appropriate inlet as shown. The steam heats and hydrates the chips such that air is driven out of the chips and replaced by steam, as is known. The thus "pre-impregnated" chips pass into the cooking liquor, which liquor enters the impregnation vessel through the inlet shown. The cooking liquor temperature is lower than that of the steam. When the hot steam-impregnated chips contact the cooler cooking liquor, the steam in the chips is displaced by the cooking liquor, whereby the chips are impregnated with cooking liquor. The impregnated chips, or impregnated lignocellulosic material, together with excess or spent cooling liquor, exit the lower end of the impregnation vessel via a chip feeding/pumping system as a sluicing mixture.

So long as the impregnation vessel is adapted to produce impregnated lignocellulose material, the impregnation vessel is not particularly limited. In one embodiment, the impregnation vessel is a white liquor impregnation vessel. In one embodiment, the impregnation vessel is an atmospheric steaming and impregnating device. Such impregnation vessels and chip feeding and pumping systems are known, e.g., Diamondback™ chip bin, available from Johansson, Turbo-Feed™ System from Andritz Glens Falls, N.Y., and IMP-BIN™ Feeding system from Valmet, Curitiba Brazil or Karlstad Sweden.

Figure 3:
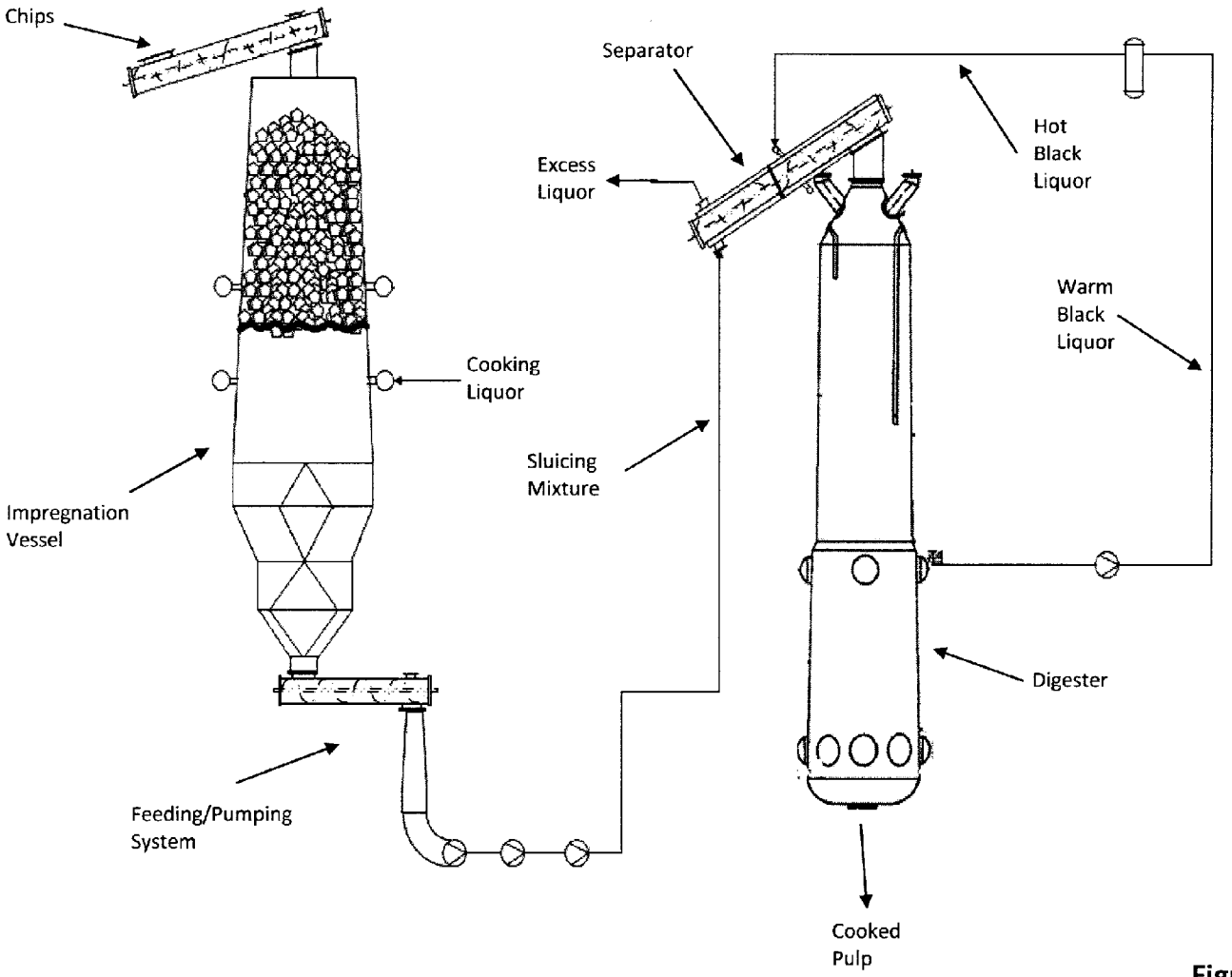
FIG. 3 shows a schematic representation of another embodiment.

In one embodiment, the sluicing mixture is pumped to the sluicing mixture inlet at the top separator, such as shown in FIG. 3.

Figure 4:
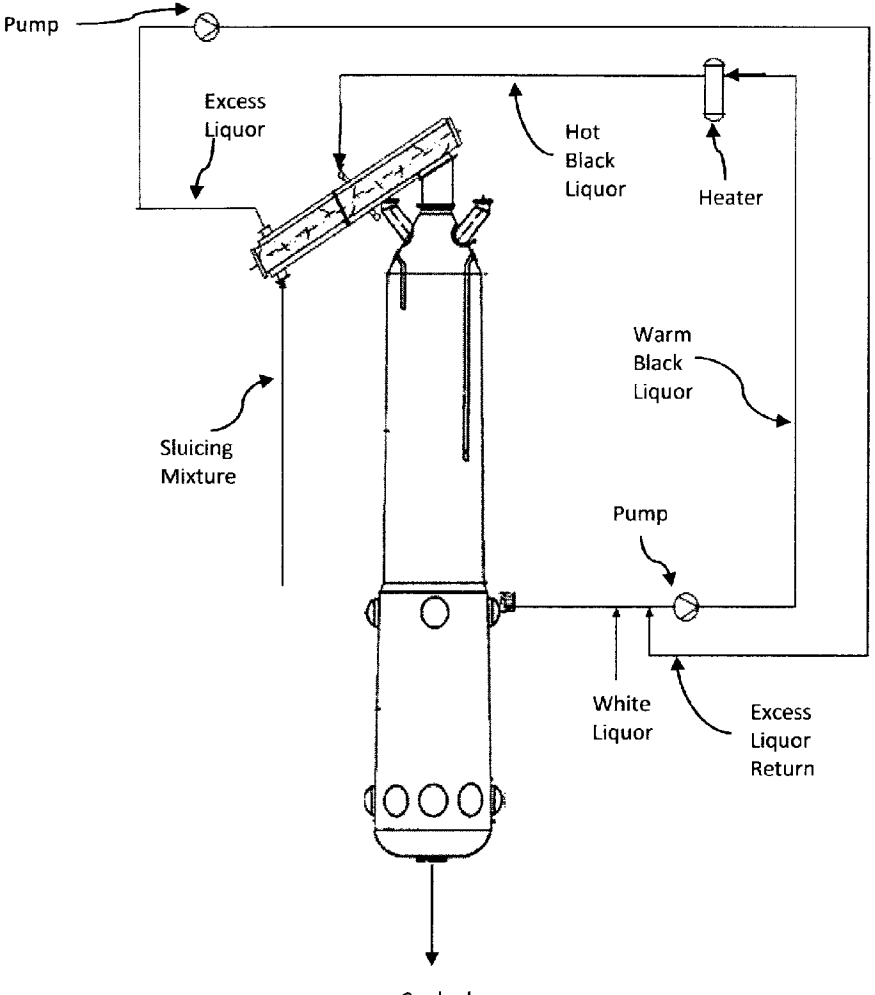
FIG. 4 shows a schematic representation of another embodiment.

FIG. 4 shows a schematic drawing of another embodiment of the top separator and digester vessel. One embodiment of a first excess liquor loop is shown. Excess liquor, e.g., liquor obtained from separating the impregnated lignocellulosic material from the sluicing mixture in the separator, exits the separator via the excess liquor outlet. In this embodiment, the excess liquor enters the upstream portion of the excess liquor loop. The excess liquor is optionally pumped by a pump to where it joins the black liquor heating and circulation loop at the excess liquor return, where it combines with the black liquor. The excess liquor return can be located anywhere along the length of the black liquor heating and circulation loop, but is preferably located at an upstream end thereof joined as shown with the warm black liquor. Optionally, fresh white liquor may also be introduced into the black liquor heating and circulation loop as shown. Similarly, the white liquor may be introduced anywhere along the length of the black liquor heating and circulation loop. Alternatively, the excess liquor and white liquor may first combine with one another before being introduced into the black liquor heating and circulation loop.

Figure 5:
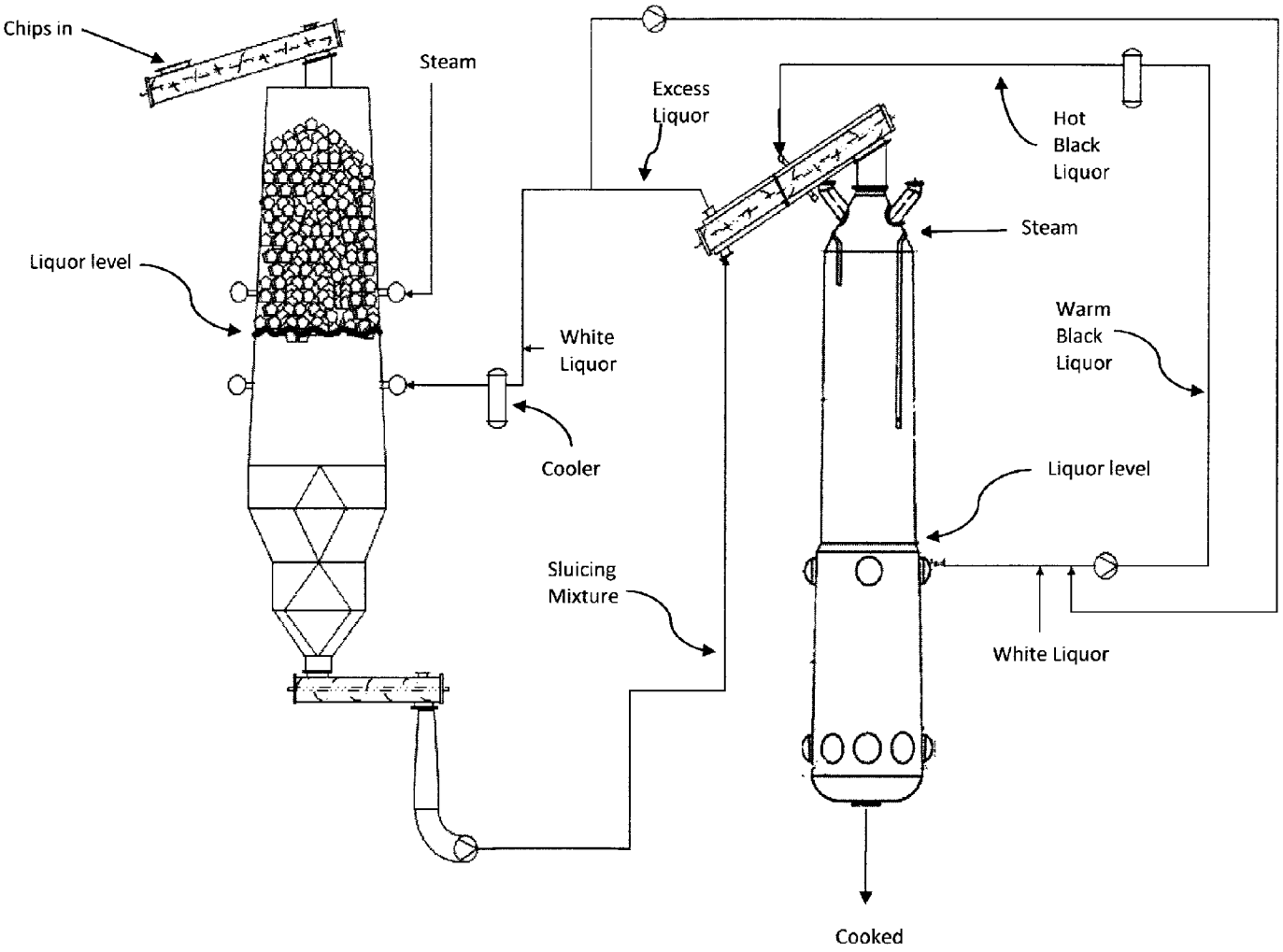
FIG. 5 shows a schematic representation of another embodiment.

FIG. 5 shows a schematic drawing of another embodiment. Another embodiment of an excess liquor loop is shown. Excess liquor exits the separator; a portion may enter the first excess liquor loop described above; and a second portion is sent to the impregnation vessel as cooking liquor or as part of the cooking liquor. In this second excess liquor loop, white liquor may be optionally added to the excess liquor, and the combined excess liquor and white liquor enter the impregnation vessel as cooking liquor. An optional cooler is shown for temperature control. Optionally, one or more of a heater (not shown), circulation pump (not shown), or both may be present anywhere along the second excess liquor loop between the excess liquor outlet of the separator and the cooking liquor inlet of the impregnation vessel.

Also shown in FIG. 5 are schematic representations of the liquor levels in the impregnation vessel and the digester.

Also shown in FIG. 5 is an optional steam inlet for introducing steam into the digester.

Figure 6:
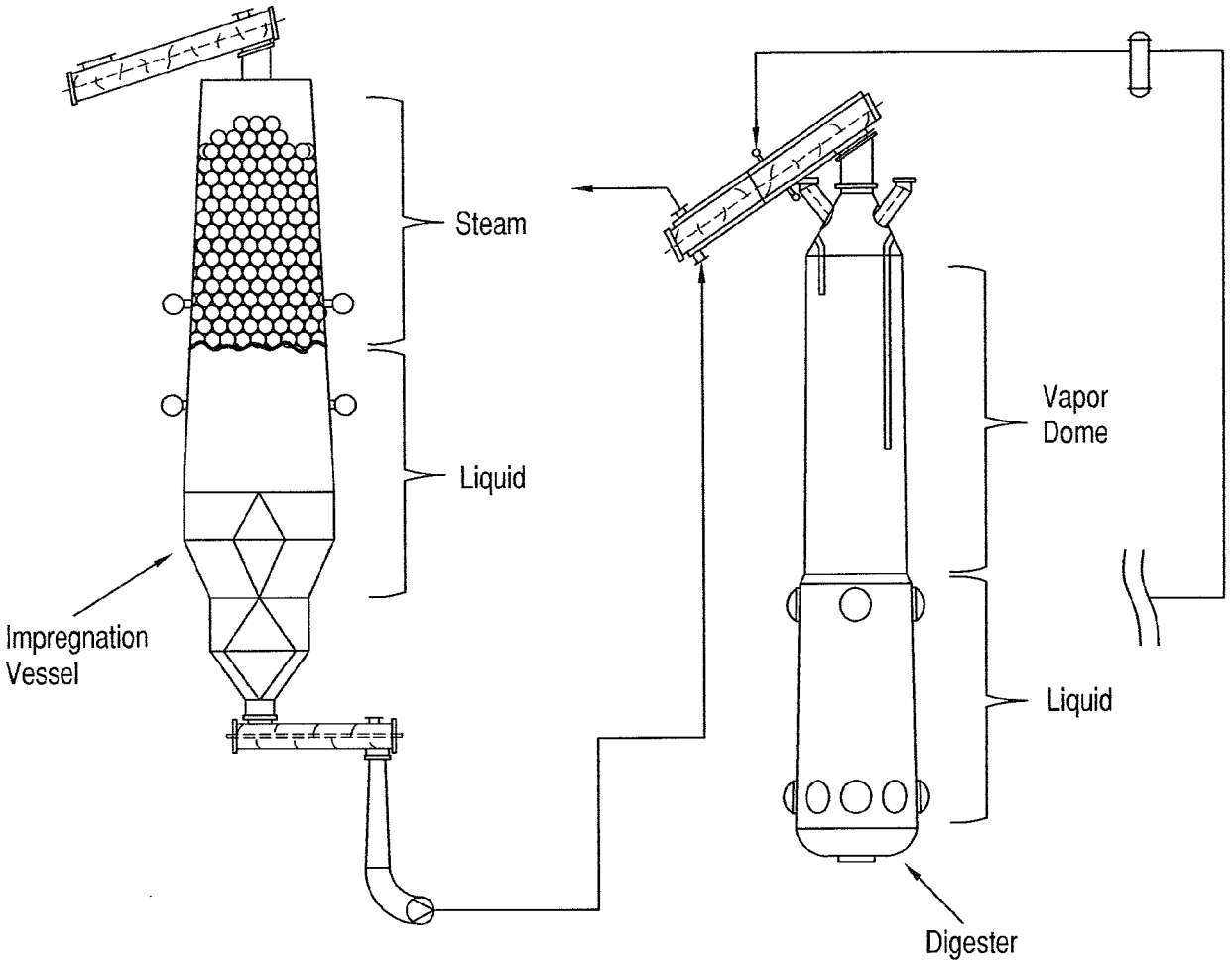
FIG. 6 shows a schematic representation of another embodiment.

FIG. 6 shows a schematic drawing of another embodiment. Schematic representations of cooking liquids in the lower portions of steam and vapor dome sections in the upper portions of the impregnation vessel and digester are shown, the respective intersections of which correspond to the liquor levels such as shown in FIG. 5.

In the Kraft process, the wood chips fed to the impregnation vessel are not particularly limiting. They may be comprised of any type of wood normally used in papermaking. The chips may be obtained from hardwood trees, softwood trees, or a combination of hardwood and softwood trees. Hardwood trees include deciduous trees (angiosperms) such as birch, oak, beech, maple, and eucalyptus. Softwood trees include coniferous trees (gymnosperms) such as varieties of fir, spruce, and pine, as for example loblolly pine, slash pine, Colorado spruce, balsam fir and Douglas fir.

When both hardwood and softwood chips are used, the hardwood/softwood chip weight ratio fed to the impregnation vessel may optionally range from 0.001 to 1000. In one embodiment, the hardwood/softwood chip weight ratio may range from 90/10 to 30/60. These ranges independently include all values and subranges therebetween, including 0.001, 0.002, 0.005, 0.01, 0.02, 0.05, 0.1, 0.2, 0.5, 1, 2, 5, 10, 15, 20, 25, 30, 35, 40, 45, 50, 55, 60, 65, 70, 75, 80, 85, 90, 95, 100, 200, 300, 400, 500, 600, 700, 800, 900, and 1000.

The wood chips may have any size suitably used in pulp production. For example, the chips may have a size ranging from 10-40 millimeters long and 1-15 millimeters thick. These ranges independently include all values and subranges therebetween, including, 1, 2, 3, 4, 5, 6, 7, 8, 9, 10, 11, 12, 13, 14, 15, 16, 17, 18, 19, 20, 21, 22, 23, 24, 25, 27, 30, 33, 35, and 40 mm.

The cooking liquor for the impregnation is not particularly limiting, but the impregnation is preferably white liquor impregnation. Typical cooking chemicals include water and one or more of sodium oxide, sodium hydroxide, sodium sulfide, sodium hydrosulfide, sodium carbonate, sodium sulfate, sodium thiosulfate, sodium sulfite, green liquor, weak black liquor, weak black liquor having up to 20% solids, or a combination of two or more thereof. In one embodiment, the cooking liquor includes sodium hydroxide, sodium sulfide, and water. Typically, the pH of the cooking liquor ranges from 12-14, as is known.

The sluicing mixture is that mixture of impregnated lignocellulosic material and sluicing liquor that results from the impregnation. In one embodiment, in addition to the impregnated lignocellulosic material, the sluicing mixture includes sluicing liquor, white liquor, water, black liquor, weak black liquor, spent cooking liquor, or a combination of two or more thereof.

In one embodiment, the sluicing liquor includes one or more of white liquor, spent cooking liquor, black liquor, weak black liquor, water, or a combination of two or more thereof.

In one embodiment, the excess liquor is that liquor which is separated from the impregnated lignocellulosic material in the separator or otherwise exits the separator after the separation. In one embodiment, the excess liquor includes one or more of sluicing liquor and black liquor. In one embodiment, the excess liquor includes sluicing liquor. It is possible, of course that the excess liquor also includes some impregnated lignocellulosic material.

Including the pre-steaming and cooking, the time the chips spend in the impregnation vessel is not particularly limiting, and may suitably range from about 20 minutes to 5 hours. This range includes all values and subranges therebetween, including 20, 30, 40, 50, 60, 70, 80, 90 minutes, 2, 3, 4, or 5 hours, or any combination thereof.

In one embodiment, the impregnation vessel is adapted to impregnate lignocellulose material at ambient pressure and at a temperature below the boiling point of one or more of sluicing liquor, cooking liquor, white liquor, excess liquor, black liquor, weak black liquor, or a combination of two or more thereof. In one embodiment, the impregnation vessel is open to the atmosphere.

In one embodiment, the impregnation vessel is adapted to impregnate lignocellulose material at ambient pressure and at a temperature below the boiling point of all of the sluicing liquor, cooking liquor, white liquor, excess liquor, green liquor, black liquor, and weak black liquor.

In one embodiment, the separator is adapted to receive the sluicing mixture at a first temperature, separate the impregnated lignocellulosic material from the sluicing mixture, and heat the impregnated lignocellulosic material to a second temperature higher than the first temperature. In one embodiment, the first temperature is about 100-130° C., and the second temperature is higher. In one embodiment, the first temperature is about 100° C., and the second temperature is higher than about 100° C.

In one embodiment, the inclined top separator is pressurizable. For example, the separator is adapted to operate at a pressure higher than ambient pressure. In one embodiment, the separator operates at the lowest pressure provided at one or more of the sluicing mixture inlet, excess liquor outlet, hot black liquor inlet, and impregnated lignocellulosic material outlet. In one embodiment, the separator operates at a pressure and temperature condition below the boiling point of sluicing liquor, white liquor, excess liquor, hot black liquor, or combination of two or more thereof.

In one embodiment, the inclined top separator is adapted to convey impregnated lignocellulosic material to the impregnated lignocellulosic material outlet at a temperature above the boiling point at ambient pressure of one or more of the sluicing liquor, white liquor, excess liquor, hot black liquor, or combination of two or more thereof but at a pressure sufficient to prevent boiling of one or more of sluicing liquor, white liquor, excess liquor, hot black liquor, or combination of two or more thereof.

In one embodiment, the inclined top separator is adapted to convey impregnated lignocellulosic material to the impregnated lignocellulosic material outlet at a temperature above the boiling point at ambient pressure of all of the sluicing liquor, white liquor, excess liquor, and hot black liquor, but at a pressure sufficient to prevent boiling all of the sluicing liquor, white liquor, excess liquor, and hot black liquor.

The time the impregnated lignocellulosic material spends in the digester vessel is not particularly limiting, and may suitably range from about 20 minutes to 3 hours. This range includes all values and subranges therebetween, including 20, 30, 40, 50, 60, 70, 80, 90 minutes, 2, 3 hours, or any combination thereof.

The amount of cooked pulp produced is not particularly limting, and may suitably range from about 100 to 5000 admt/day. This range includes all values and subranges therebetween, including about 100, 200, 300, 500, 700, 900, 1000, 1100, 1200, 1300, 1400, 1500, 1700, 1900, 2000, 2200, 2400, 2500, 2600, 2800, 3000, 4000, and 5000 admt/day of pulp.

The cooked pulp may be suitably withdrawn or discharged from the digester vessel. In one embodiment, the cooked pulp may be suitably converted into a paper product according to known methods, e.g., one or more of blowing, screening, washing, bleaching, fiberizing, sizing, pressing, calendaring, drying, baling, rolling, and the like.

Figure 7:
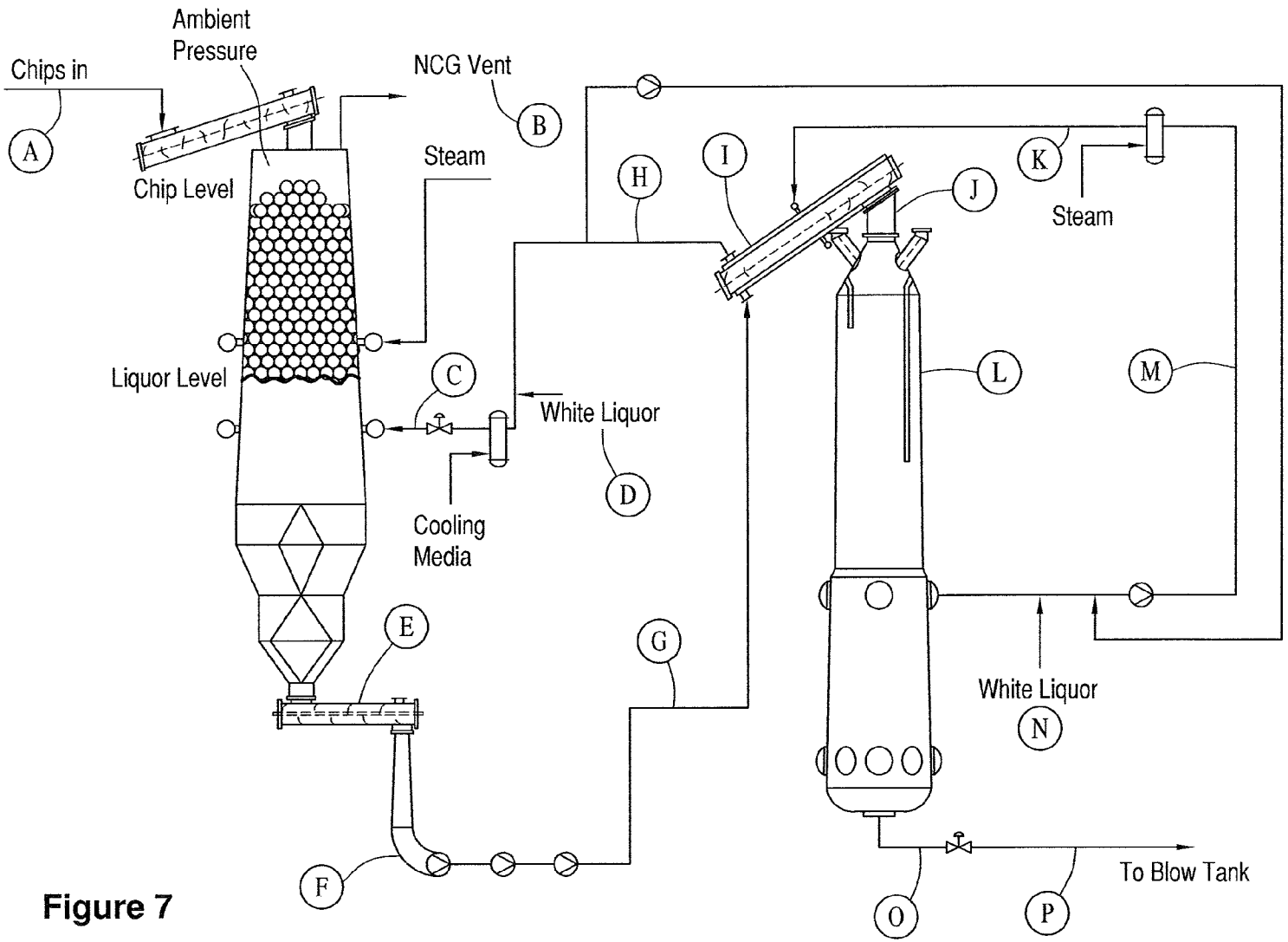
FIG. 7 shows a schematic representation of another embodiment.

FIG. 7 shows a schematic representation of one embodiment, wherein the various stages are illustrated as "A", "B", "C", etc. These stages are independently referred to in the paragraphs below.

In one embodiment, referring to stage A, the temperature and pressure under which the chips are fed are not particularly limiting. In one embodiment, the temperature may range from about 20 to about 50° C., which range includes all values and subranges therebetween, for example about 20, 21, 22, 23, 24, 25, 26, 27, 28, 29, 30, 35, 40, 45, and 50° C. In one embodiment, the pressure may range from about 0.5 bar to about 3 bar, which range includes all values and subranges therebetween, for example, about 0.5, 0.6, 0.7, 0.8, 0.9, 1, 2, and 3 bar. In one embodiment, the temperature and pressure of the chips at stage A are about 25° C. and about 1 bar.

In one embodiment, referring to stage B, the impregnation vessel may be freely or controllably vented to the atmosphere, blow tank, gas collection system, gas treatment system, or similar. In one embodiment, the temperature at the vent may range from about −50 to +150° C., which range includes all values and subranges therebetween, for example about −50, −40, −30, −20, −10, 0, 10, 20, 25, 30, 40, 50, 60, 70, 80, 90, 91, 92, 93, 94, 95, 96, 97, 98, 99, 100, 101, 103, 105, 107, 109, 110, 120, 130, 140, and 150° C. In one embodiment, the pressure may range from about 0.5 bar to about 2 bar, which range includes all values and subranges therebetween, for example, about 0.5, 0.6, 0.7, 0.8, 0.9, 1, and 2 bar. In one embodiment, the vent pressure is ambient pressure. In one embodiment, the vent temperature and pressure at stage B are about 100° C. and about 1 bar.

In one embodiment, referring to stage C, the temperature of the cooking liquor may suitably range from 50-130° C., which range includes all values and subranges therebetween, for example 50, 60, 70, 80, 90, 91, 92, 93, 94, 95, 96, 97, 98, 99, 100, 101, 103, 105, 107, 109, 110, 120, and 130° C. In one embodiment, the temperature is about 100-110° C.

In one embodiment, referring to stage D, the temperature of the white liquor may suitably range from 40-120° C., which range includes all values and subranges therebetween, for example 40, 50, 60, 70, 80, 90, 91, 92, 93, 94, 95, 96, 97, 98, 99, 100, 101, 103, 105, 107, 109, 110, and 120° C. In one embodiment, the temperature is about 50-90° C.

In one embodiment, referring to stage E, the temperature of the sluicing mixture at the lower end of the impregnation vessel may suitably range from 50-130° C., which range includes all values and subranges therebetween, for example 50, 60, 70, 80, 90, 91, 92, 93, 94, 95, 96, 97, 98, 99, 100, 101, 103, 105, 107, 109, 110, 120, and 130° C. In one embodiment, the temperature is about 100-115° C.

In one embodiment, referring to stage F, the pressure of the sluicing mixture at the lower end of the impregnation vessel and upstream of one or more optional sluicing mixture pumps may suitably range from about 1 to 4 bar, which range includes all values and subranges therebetween, for example about 1, 2, 3, and 4 bar. In one embodiment, the pressure is about ambient plus static pressure.

In one embodiment, referring to stage G, the temperature of the sluicing mixture downstream of one or more sluicing mixture pumps may suitably range from 50-130° C., which range includes all values and subranges therebetween, for example 50, 60, 70, 80, 90, 91, 92, 93, 94, 95, 96, 97, 98, 99, 100, 101, 103, 105, 107, 109, 110, 120, and 130° C. In one embodiment, the temperature is about 100-115° C.

In one embodiment, referring to stage G, the pressure of the sluicing mixture downstream of one or more sluicing mixture pumps may suitably range from about 4 to 15 bar, which range includes all values and subranges therebetween, for example about 4, 5, 6, 7, 8, 9, 10, 11, 12, 13, 14, and 15 bar. In one embodiment, the pressure is about 6-9 bar plus static head.

In one embodiment, referring to stage H, the temperature of the excess liquor may suitably range from 80-140° C., which range includes all values and subranges therebetween, for example 80, 90, 91, 92, 93, 94, 95, 96, 97, 98, 99, 100, 101, 103, 105, 107, 109, 110, 120, 130, and 140° C. In one embodiment, the temperature is about 100-130° C.

In one embodiment, referring to stage I, the pressure of the excess liquor may suitably range from about 4 to 15 bar, which range includes all values and subranges therebetween, for example about 4, 5, 6, 7, 8, 9, 10, 11, 12, 13, 14, and 15 bar. In one embodiment, the pressure is about 6-9 bar.

In one embodiment, referring to stage J, the temperature of the impregnated lignocellulosic material at the impregnated cellulosic material outlet of the separator may suitably range from 60-185° C., which range includes all values and subranges therebetween, for example 60, 70, 80, 90, 100, 105, 110, 115, 120, 125, 130, 140, 145, 150, 155, 160, 165, 170, 175, 180, and 185° C. In one embodiment, the temperature is about 140-165° C.

In one embodiment, referring to stage J, the pressure of the impregnated lignocellulosic material at the impregnated cellulosic material outlet of the separator may suitably range from about 4 to 15 bar, which range includes all values and subranges therebetween, for example about 4, 5, 6, 7, 8, 9, 10, 11, 12, 13, 14, and 15 bar. In one embodiment, the pressure is about 6-9 bar.

In one embodiment, referring to stage K, the temperature of the hot black liquor in the heating and circulation loop may suitably range from about 140-185° C., which range includes all values and subranges therebetween, for example 140, 145, 150, 155, 160, 165, 170, 175, 180, and 185° C. In one embodiment, the temperature is about 140-170° C.

In one embodiment, referring to stage K, the pressure of the hot black liquor in the heating and circulation loop may suitably range from about 4 to 15 bar, which range includes all values and subranges therebetween, for example about 4, 5, 6, 7, 8, 9, 10, 11, 12, 13, 14, and 15 bar. In one embodiment, the pressure is about 6-9 bar.

In one embodiment, referring to stage L, the temperature of the digester may suitably range from about 140-185° C., which range includes all values and subranges therebetween, for example 140, 145, 150, 155, 160, 165, 170, 175, 180, and 185° C. In one embodiment, the temperature is about 140-165° C.

In one embodiment, referring to stage L, the pressure of the digester may suitably range from about 4 to 15 bar, which range includes all values and subranges therebetween, for example about 4, 5, 6, 7, 8, 9, 10, 11, 12, 13, 14, and 15 bar. In one embodiment, the pressure is about 6-9 bar.

In one embodiment, referring to stage M, the temperature of the warm black liquor in the heating and circulation loop may suitably range from about 130-180° C., which range includes all values and subranges therebetween, for example 130, 140, 145, 150, 155, 160, 165, 170, 175, and 180° C. In one embodiment, the temperature is about 140-170° C.

In one embodiment, referring to stage M, the pressure of the warm black liquor in the heating and circulation loop may suitably range from about 4 to 15 bar, which range includes all values and subranges therebetween, for example about 4, 5, 6, 7, 8, 9, 10, 11, 12, 13, 14, and 15 bar. In one embodiment, the pressure is about 6-9 bar.

In one embodiment, referring to stage N, the temperature of the white liquor introduced into the black liquor heating and circulation loop may suitably range from 40-130° C., which range includes all values and subranges therebetween, for example 40, 50, 60, 70, 80, 90, 100, 110, 120, and 130° C. In one embodiment, the temperature is about 50-90° C.

In one embodiment, referring to stage N, the white liquor may be heated independently in a separate heater before it is introduced into the black liquor heating and circulation loop.

In one embodiment, referring to stage O, the temperature of the cooked pulp may suitably range from 80-135° C., which range includes all values and subranges therebetween, for example 80, 90, 100, 105, 110, 115, 120, 125, 130, and 130° C. In one embodiment, the temperature is about 90-99° C.

In one embodiment, referring to stage P, the pressure of the cooked pulp downstream of an optional blow valve or similar may suitably range from about 1 to 3 bar, which range includes all values and subranges therebetween, for example about 1, 2, and 3 bar. In one embodiment, the pressure is about ambient plus static pressure.

Figure 8:
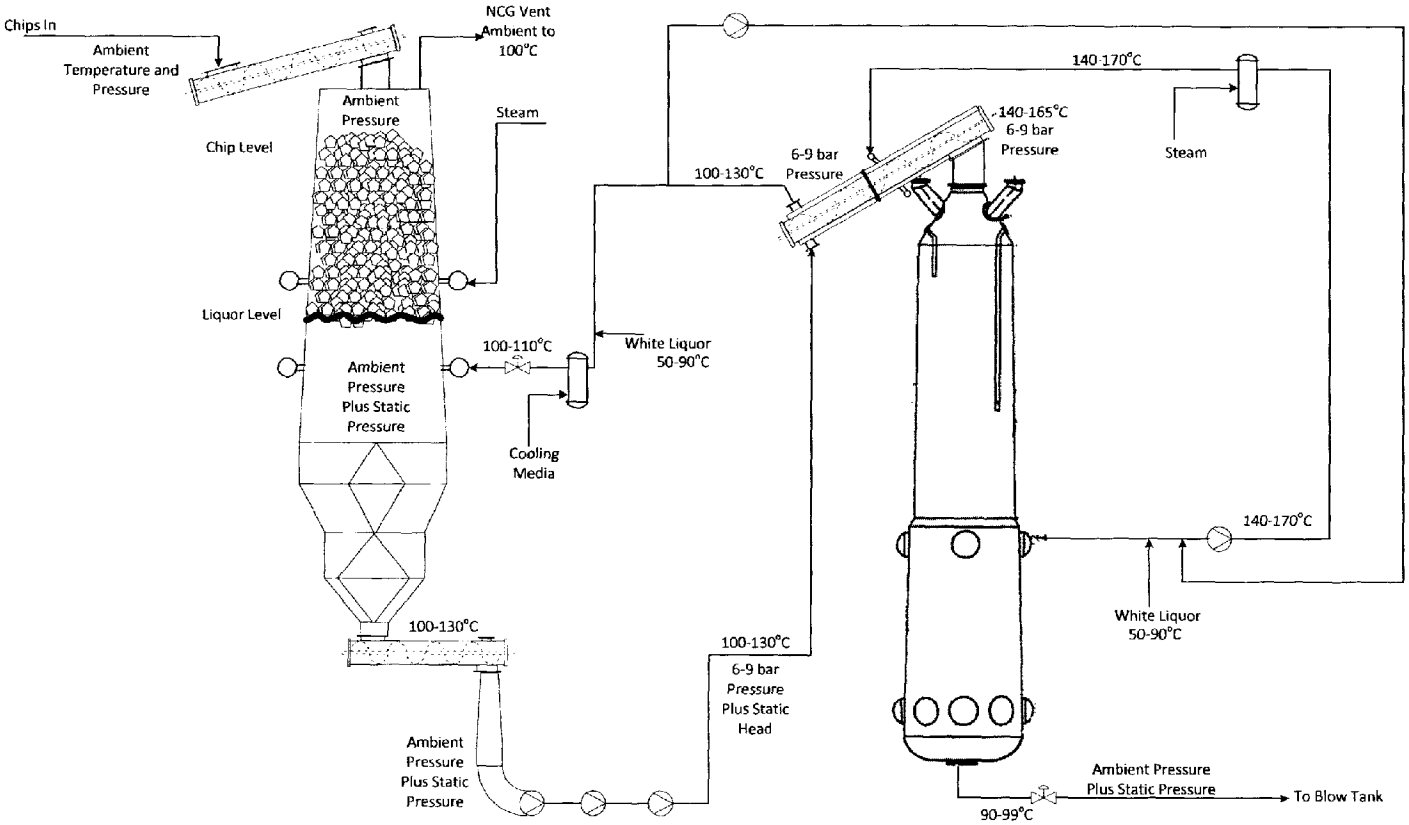
FIG. 8 shows a schematic representation of another embodiment.

FIG. 8 shows a schematic representation of another embodiment, wherein various temperature and pressure conditions are independently shown.

In one embodiment, the impregnation vessel chip bin is large enough to allow for steam treatment of the chips above a section where the chips soak in cooking liquor. Although any atmospheric steaming and impregnating vessel may be used, in one embodiment, a Diamondback™ Chip bin is used in the impregnation vessel. Chip retention time above the cooking liquor is appropriate for proper chip steaming and, once submerged, appropriate for proper chip liquor impregnation. Steam is introduced into the dry chip mass to steam the chips prior to impregnation with cooking liquor. The impregnation vessel operates at atmospheric conditions and as such the liquor in the bin is not above the boiling point. The sluicing mixture is discharged from the Diamondback™ Chip bin via a rotating discharger which also serves as a meter for the sluicing mixture controlling the production rate of the unit. From there the sluicing mixture flows thorough a TurboFeed™ system being pumped to the digester vessel. At the top of the digester an external inclined top separator device is utilized to transfer the impregnated chips into the digester vessel. The top separator is equipped with a screen and screw system that separates the impregnated chips from the sluicing liquor. The low temperature sluicing liquor is fortified with fresh cooking liquor (white liquor) and/or weak black liquor from the washing system, the pressure would be reduced and the liquor returned to the Diamondback™ Chip bin. As the impregnated chips are transported up the screw of the inclined top separator, excess liquor which has been removed from the digester vessel and fortified with additional cooking liquor and heated to the appropriate cooking temperature is added to the system. The inclined screw acts to keep the sluicing liquor cool while heating the impregnated chips and remaining liquor going to the digester at much higher cooking temperatures. A cooling heat exchanger is installed in the chip transportation loop to allow for temperature adjustment during upset conditions. An excess liquor circuit is included to pump excess liquor from the chip feed system into the digester circuit to maintain the liquor operating level in the chip bin. In this way the chips are impregnated with cooking liquor at a low temperature while the chips are introduced into the digester vessel at high temperature maintaining the production capacity of the system. The external inclined top separator allows the two circuits to operate at vastly different temperatures with very little mixing thereby maintaining the energy efficiency of the system.

In the embodiment shown in FIG. 8, an atmospheric chip steaming/impregnating system such as the Diamondback™ Chip bin is shown.

Figure 9:
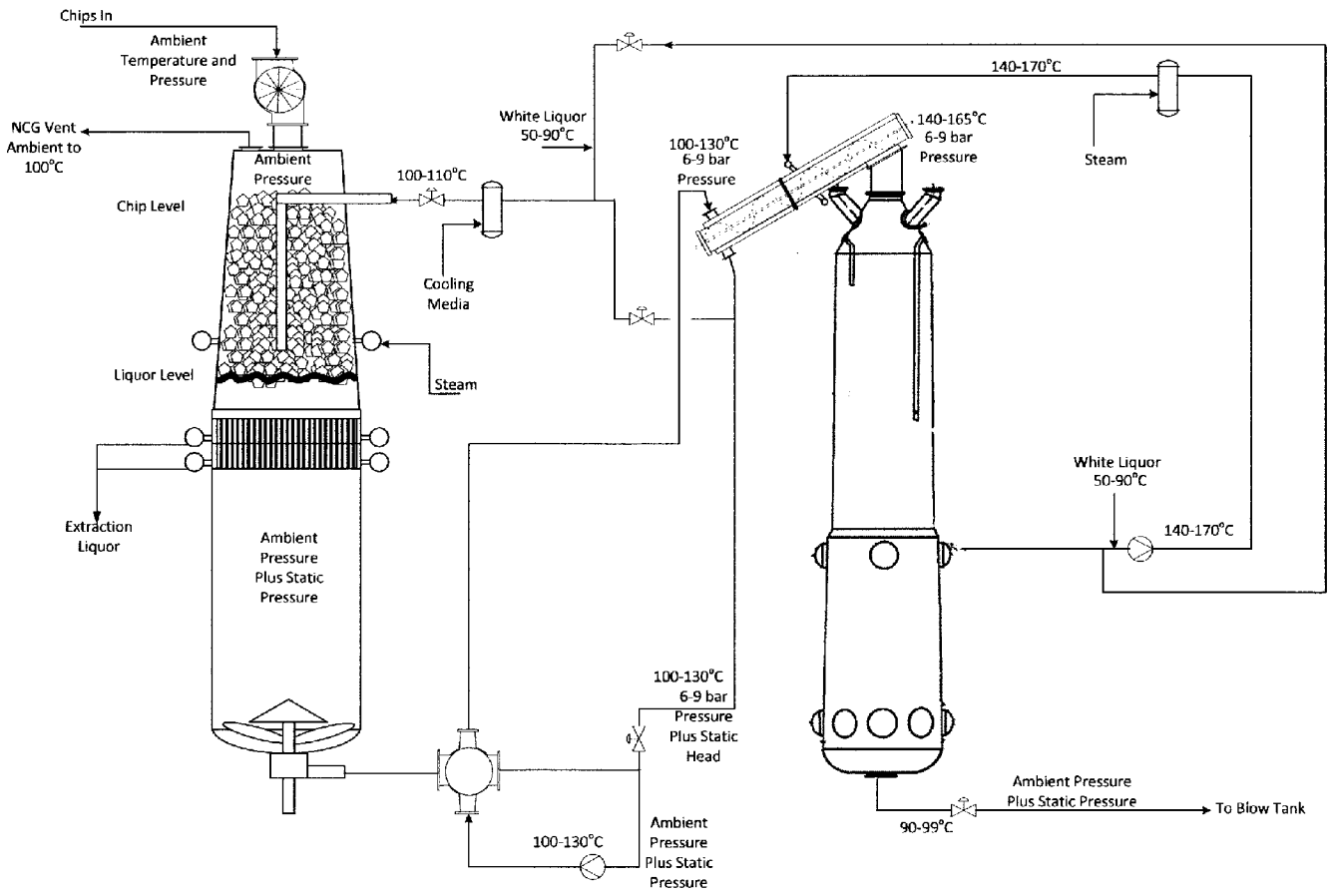
FIG. 9 shows a schematic representation of another embodiment.

In the embodiment shown in FIG. 9, an atmospheric chip steaming/impregnating system such as the IMPBIN is shown.

Various other embodiments are shown below.

One embodiment provides an apparatus for cooking lignocellulosic material, comprising:

- a pressurizable, inclined top separator including a sluicing liquor inlet for receiving a sluicing mixture comprising impregnated lignocellulosic material and sluicing liquor, a hot black liquor inlet, an excess liquor outlet, and an impregnated lignocellulosic material outlet;
- a continuous digester vessel including an impregnated lignocellulosic material inlet in communication with the impregnated lignocellulosic material outlet, and a warm black liquor outlet; and
- a black liquor circulation and heating loop including a warm black liquor inlet in communication with the warm black liquor outlet, a heater for heating warm black liquor to produce hot black liquor, and a hot black liquor outlet in communication with the hot black liquor inlet.

Another embodiment provides an apparatus, wherein the inclined top separator comprises one or more of a screen or screw and is adapted to separate impregnated lignocellulosic material from at least a portion of sluicing liquor.

Another embodiment provides an apparatus, wherein the inclined top separator includes an upper end and a lower end; the impregnated lignocellulosic material outlet being disposed at the upper end; and the sluicing liquor inlet being disposed at the lower end.

Another embodiment provides an apparatus, wherein the inclined top separator is adapted to operate at a pressure of 4-15 bar.

Another embodiment provides an apparatus, wherein the inclined top separator, sluicing liquor inlet, or both are adapted to receive sluicing mixture at a temperature of 50-130° C.

Another embodiment provides an apparatus, wherein the sluicing mixture comprises one or more of white liquor, spent cooking liquor, water, or a combination thereof.

Another embodiment provides an apparatus, wherein the inclined top separator is adapted to heat impregnated lignocellulose material to a temperature of 60-185° C.

Another embodiment provides an apparatus, wherein the inclined top separator is adapted to cool or maintain white liquor, excess liquor, or both to or at a temperature of 60-130° C.

Another embodiment provides an apparatus, wherein the inclined top separator, hot black liquor inlet, or both are adapted to receive hot black liquor at a temperature of 140-185° C.

Another embodiment provides an apparatus, wherein the inclined top separator is adapted to operate at a pressure and temperature condition below the boiling point of sluicing liquor, white liquor, excess liquor, hot black liquor, or combination of two or more thereof.

Another embodiment provides an apparatus, wherein the inclined top separator is adapted to convey impregnated lignocellulosic material to the impregnated lignocellulosic material outlet at a temperature above the boiling point at ambient pressure of sluicing liquor, white liquor, excess liquor, hot black liquor, or combination of two or more thereof but at a pressure sufficient to prevent boiling of sluicing liquor, white liquor, excess liquor, hot black liquor, or combination of two or more thereof.

Another embodiment provides an apparatus, wherein the inclined top separator is adapted to convey impregnated lignocellulosic material to the impregnated lignocellulosic material outlet.

Another embodiment provides an apparatus, wherein the inclined top separator is adapted to convey the impregnated lignocellulosic material to the impregnated lignocellulosic material outlet at a temperature of 60-185° C.

Another embodiment provides an apparatus, wherein the inclined top separator is adapted to convey impregnated lignocellulosic material and at least a portion of white liquor to the impregnated lignocellulosic material outlet.

Another embodiment provides an apparatus, wherein the inclined top separator is adapted to convey impregnated lignocellulosic material, hot black liquor, and at least a portion of white liquor to the impregnated lignocellulosic material outlet.

Another embodiment provides an apparatus, wherein the inclined top separator is adapted to convey impregnated lignocellulosic material, hot black liquor, and one or more of sluicing liquor, white liquor, or a combination thereof to the impregnated lignocellulosic material outlet.

Another embodiment provides an apparatus, wherein the inclined top separator is adapted to combine impregnated lignocellulosic material with hot black liquor.

Another embodiment provides an apparatus, wherein the digester vessel is a vapor-phase digester or hydraulic digester.

Another embodiment provides an apparatus, wherein the digester vessel is a single vessel digester or a two-vessel digester.

Another embodiment provides an apparatus, wherein the digester vessel is adapted to produce cooked pulp from impregnated lignocellulose material.

Another embodiment provides an apparatus, wherein the digester vessel is adapted to operate at a temperature of 140-185° C.

Another embodiment provides an apparatus, wherein the digester vessel is adapted to operate at a pressure of 4-15 bar.

Another embodiment provides an apparatus, wherein the digester vessel comprises a steam inlet, cooked pulp outlet, or both.

Another embodiment provides an apparatus, wherein the digester vessel includes an upper end and a lower end; the impregnated lignocellulosic material inlet being disposed at the upper end; a cooked pulp outlet being disposed at the lower end; and the warm black liquor outlet being disposed between the upper end and lower end.

Another embodiment provides an apparatus, wherein the black liquor circulation and heating loop comprises a white liquor inlet, an excess liquor inlet in communication with the excess liquor outlet, a circulation pump, or a combination of two or more thereof.

Another embodiment provides an apparatus, wherein the black liquor circulation and heating loop is adapted to operate at a pressure of 4-15 bar.

Another embodiment provides an apparatus, wherein the heater is adapted to receive and heat warm black liquor having a temperature of 130-180° C. to produce hot black liquor having a temperature of 140-185° C.

Another embodiment provides an apparatus, comprising an ambient pressure impregnation vessel in communication with the sluicing liquor inlet and adapted to produce impregnated lignocellulose material.

Another embodiment provides an apparatus, wherein the impregnation vessel is adapted to impregnate lignocellulose material at ambient pressure and at a temperature below the boiling point of white liquor, excess liquor, weak black liquor, or a combination of two or more thereof.

Another embodiment provides an apparatus, wherein the ambient pressure impregnation vessel comprises a sluicing mixture outlet in communication with the sluicing liquor inlet of the inclined top separator.

Another embodiment provides a process, comprising producing a cooked pulp using the apparatus.

Another embodiment provides a process for cooking pulp, comprising introducing, under pressure, a sluicing mixture comprising impregnated lignocellulosic material and sluicing liquor into a pressurized, inclined top separator;

heating and separating, under pressure, the impregnated lignocellulosic material in the inclined top separator from at least a portion of the sluicing liquor, to produce heated impregnated lignocellulosic material; and conveying, under pressure, the heated impregnated lignocellulosic material to a continuous, pressurized digester vessel, and cooking, to produce a cooked pulp;

wherein the pressures in the introducing, heating, separating, and conveying are sufficient to prevent the sluicing liquor from boiling.

Another embodiment provides a process, wherein the sluicing mixture comprises one or more of white liquor, spent cooking liquor, water, or a combination thereof.

Another embodiment provides a process, wherein the heating comprises contacting the impregnated lignocellulosic material with hot black liquor.

Another embodiment provides a process, wherein the cooking comprises cooking the heated impregnated lignocellulosic material in black liquor.

Another embodiment provides a process, comprising withdrawing warm black liquor from the digester vessel, heating the warm black liquor to produce hot black liquor, sending the hot black liquor to the separator, and contacting, under pressure in the separator, the hot black liquor with the impregnated lignocellulosic mateal to heat the impregnated lignocellulosic material.

Another embodiment provides a process, comprising introducing steam into the digester vessel.

Another embodiment provides a process, comprising removing the portion of sluicing liquor from the separator as excess liquor, and contacting all or a portion of the excess liquor with warm black liquor, the warm black liquor having been withdrawn from the digester vessel.

Another embodiment provides a process, comprising withdrawing warm black liquor from the digester vessel and, optionally, contacting the warm black liquor with white liquor.

Another embodiment provides a process, comprising, in an ambient pressure impregnation vessel, contacting lignocellulosic chips with steam and thereafter with cooking liquor, to impregnate the lignocellulosic chips with cooking liquor and produce the impregnated lignocellulose material.

Another embodiment provides a process, wherein the cooking liquor comprises white liquor and optionally one or more of excess liquor, weak black liquor, or a combination thereof.

Another embodiment provides a process, wherein the impregnating is carried out at ambient pressure and at a temperature below the boiling point of the cooking liquor.

Another embodiment provides a process, comprising removing the portion of sluicing liquor from the separator as excess liquor, and sending all or a portion of the excess liquor to the impregnation vessel as cooking liquor.

Another embodiment provides a process, comprising, after the removing and prior to the sending, one or more of contacting all or a portion of the excess liquor with white liquor, cooling all or a portion of the excess liquor, or combination thereof.

Another embodiment provides a process, wherein the impregnating is carried out at a temperature of 50-130° C.

Another embodiment provides a process, comprising withdrawing the cooked pulp from the digester vessel.

Another embodiment provides a process, comprising converting all or a portion of the cooked pulp into a paper product.

By resort to one or more embodiments herein, an easily retrofitable, relatively low capital upgrade to single vessel vapor phase digester systems may be achieved. Cooking uniformity and subsequent bleachability of the resulting pulp may be enhanced, and the more uniformly cooked pulp can have substantially less reject content as well.

The invention claimed is:

1. An apparatus for cooking lignocellulosic material, comprising:

a pressurizable, inclined top separator including a sluicing liquor inlet for receiving a sluicing mixture comprising impregnated lignocellulosic material and sluicing liquor, a hot black liquor inlet, an excess liquor outlet, and an impregnated lignocellulosic material outlet;

a continuous digester vessel including an impregnated lignocellulosic material inlet in communication with the impregnated lignocellulosic material outlet, and a warm black liquor outlet; and a black liquor circulation and heating loop including a warm black liquor inlet in communication with said warm black liquor outlet, a heater for heating warm black liquor to produce hot black liquor, and a hot black liquor outlet in communication with said hot black liquor inlet.

2. The apparatus of claim 1, wherein the inclined top separator further comprises one or more of a screen or screw and is adapted to separate impregnated lignocellulosic material from at least a portion of sluicing liquor.

3. The apparatus of claim 1, wherein the inclined top separator includes an upper end and a lower end; the impregnated lignocellulosic material outlet being disposed at the upper end; and the sluicing liquor inlet being disposed at the lower end.

4. The apparatus of claim 1, wherein the inclined top separator is adapted to operate at a pressure of 4-15 bar.

5. The apparatus of claim 1, wherein the inclined top separator, sluicing liquor inlet, or both are adapted to receive sluicing mixture at a temperature of 50-130° C.

6. The apparatus of claim 1, wherein the sluicing mixture further comprises one or more of white liquor, spent cooking liquor, water, or a combination thereof.

7. The apparatus of claim 1, wherein the inclined top separator is adapted to heat impregnated lignocellulose material to a temperature of 60-185° C.

8. The apparatus of claim 1, wherein the inclined top separator is adapted to cool or maintain white liquor, excess liquor, or both to or at a temperature of 60-130° C.

9. The apparatus of claim 1, wherein the inclined top separator, hot black liquor inlet, or both are adapted to receive hot black liquor at a temperature of 140-185° C.

10. The apparatus of claim 1, wherein the inclined top separator is adapted to operate at a pressure and temperature condition below the boiling point of sluicing liquor, white liquor, excess liquor, hot black liquor, or combination of two or more thereof.

11. The apparatus of claim 1, wherein the inclined top separator is adapted to convey impregnated lignocellulosic material to the impregnated lignocellulosic material outlet at a temperature above the boiling point at ambient pressure of sluicing liquor, white liquor, excess liquor, hot black liquor, or combination of two or more thereof but at a pressure sufficient to prevent boiling of sluicing liquor, white liquor, excess liquor, hot black liquor, or combination of two or more thereof.

12. The apparatus of claim 1, wherein the inclined top separator is adapted to convey impregnated lignocellulosic material to the impregnated lignocellulosic material outlet.

13. The apparatus of claim 1, wherein the inclined top separator is adapted to convey the impregnated lignocellulosic material to said impregnated lignocellulosic material outlet at a temperature of 60-185° C.

14. The apparatus of claim 1, wherein the inclined top separator is adapted to convey impregnated lignocellulosic material and at least a portion of white liquor to the impregnated lignocellulo sic material outlet.

15. The apparatus of claim 1, wherein the inclined top separator is adapted to convey impregnated lignocellulosic material, hot black liquor, and at least a portion of white liquor to the impregnated lignocellulosic material outlet.

16. The apparatus of claim 1, wherein the inclined top separator is adapted to convey impregnated lignocellulosic material, hot black liquor, and one or more of sluicing liquor, white liquor, or a combination thereof to the impregnated lignocellulosic material outlet.

17. The apparatus of claim 1, wherein the inclined top separator is adapted to combine impregnated lignocellulosic material with hot black liquor.

18. The apparatus of claim 1, wherein the digester vessel is a vapor-phase digester or hydraulic digester.

19. The apparatus of claim 1, wherein the digester vessel is a single vessel digester or a two-vessel digester.

20. The apparatus of claim 1, wherein the digester vessel is adapted to produce cooked pulp from impregnated lignocellulose material.

21. The apparatus of claim 1, wherein the digester vessel is adapted to operate at a temperature of 140-185° C.

22. The apparatus of claim 1, wherein the digester vessel is adapted to operate at a pressure of 4-15 bar.

23. The apparatus of claim 1, wherein the digester vessel further comprises a steam inlet, cooked pulp outlet, or both.

24. The apparatus of claim 1, wherein the digester vessel includes an upper end and a lower end; the impregnated lignocellulosic material inlet being disposed at the upper end; a cooked pulp outlet being disposed at the lower end; and the warm black liquor outlet being disposed between the upper end and lower end.

25. The apparatus of claim 1, wherein the black liquor circulation and heating loop further comprises a white liquor inlet, an excess liquor inlet in communication with the excess liquor outlet, a circulation pump, or a combination of two or more thereof.

26. The apparatus of claim 1, wherein the black liquor circulation and heating loop is adapted to operate at a pressure of 4-15 bar.

27. The apparatus of claim 1, wherein the heater is adapted to receive and heat warm black liquor having a temperature of 130-180° C. to produce hot black liquor having a temperature of 140-185° C.

28. The apparatus of claim 1, further comprising an ambient pressure impregnation vessel in communication with the sluicing liquor inlet and adapted to produce impregnated lignocellulose material.

29. The apparatus of claim 28, wherein the impregnation vessel is adapted to impregnate lignocellulose material at ambient pressure and at a temperature below the boiling point of white liquor, excess liquor, weak black liquor, or a combination of two or more thereof.

30. The apparatus of claim 1, claim 28, wherein the ambient pressure impregnation vessel comprises a sluicing mixture outlet in communication with the sluicing liquor inlet of the inclined top separator.

31. A process, comprising producing a cooked pulp in the apparatus of claim 1.

32. A process for cooking pulp in the apparatus of claim 1, comprising introducing, under pressure, a sluicing mixture comprising impregnated lignocellulosic material and sluicing liquor into the pressurizable, inclined top separator;

heating and separating, under pressure, the impregnated lignocellulosic material in the inclined top separator from at least a portion of the sluicing liquor, to produce heated impregnated lignocellulosic material; and conveying, under pressure, the heated impregnated lignocellulosic material to the continuous digester vessel, and cooking, to produce a cooked pulp;

wherein said pressures in the introducing, heating, separating, and conveying are sufficient to prevent said sluicing liquor from boiling.

33. The process of claim 32, wherein the sluicing mixture further comprises one or more of white liquor, spent cooking liquor, water, or a combination thereof.

34. The process of claim 32, wherein said heating comprises contacting the impregnated lignocellulosic material with hot black liquor.

35. The process of claim 32, wherein said cooking comprises cooking the heated impregnated lignocellulosic material in black liquor.

36. The process of claim 32, further comprising withdrawing warm black liquor from the digester vessel, heating the warm black liquor to produce hot black liquor, sending the hot black liquor to the separator, and contacting, under pressure in said separator, the hot black liquor with the impregnated lignocellulosic material to heat the impregnated lignocellulosic material.

37. The process of claim 32, further comprising introducing steam into the digester vessel.

38. The process of claim 32, further comprising removing said portion of sluicing liquor from the separator as excess liquor, and contacting all or a portion of said excess liquor with warm black liquor, the warm black liquor having been withdrawn from the digester vessel.

39. The process of claim 32, further comprising withdrawing warm black liquor from the digester vessel and, optionally, contacting the warm black liquor with white liquor.

40. The process of claim 32, further comprising, in an ambient pressure impregnation vessel, contacting lignocellulosic chips with steam and thereafter with cooking liquor, to impregnate the lignocellulosic chips with cooking liquor and produce the impregnated lignocellulose material.

41. The process of claim 40, wherein said cooking liquor comprises white liquor and optionally one or more of excess liquor, weak black liquor, or a combination thereof.

42. The process of claim 40, wherein said impregnating is carried out at ambient pressure and at a temperature below the boiling point of the cooking liquor.

43. The process of claim 40, further comprising removing said portion of sluicing liquor from the separator as excess liquor, and sending all or a portion of said excess liquor to the impregnation vessel as cooking liquor.

44. The process of claim 43, further comprising, after said removing and prior to said sending, one or more of contacting all or a portion of said excess liquor with white liquor, cooling all or a portion of said excess liquor, or combination thereof.

45. The process of claim 40, wherein the impregnating is carried out at a temperature of 50-130° C.

46. The process of claim 32, further comprising withdrawing the cooked pulp from the digester vessel.

47. The process of claim 46, further comprising converting all or a portion of the cooked pulp into a paper product.

* * * * *